US010047586B2

(12) United States Patent
Ferg

(10) Patent No.: US 10,047,586 B2
(45) Date of Patent: Aug. 14, 2018

(54) BACKPRESSURE BALL

(71) Applicant: Thomas Eugene Ferg, Sun City West, AZ (US)

(72) Inventor: Thomas Eugene Ferg, Sun City West, AZ (US)

( * ) Notice: Subject to any disclaimer, the term of this patent is extended or adjusted under 35 U.S.C. 154(b) by 310 days.

(21) Appl. No.: 14/634,858

(22) Filed: Mar. 1, 2015

(65) Prior Publication Data

US 2017/0089165 A1 Mar. 30, 2017

Related U.S. Application Data

(60) Provisional application No. 61/946,880, filed on Mar. 2, 2014, provisional application No. 61/976,349, filed on Apr. 7, 2014.

(51) Int. Cl.
*E21B 33/13* (2006.01)
*E21B 33/05* (2006.01)

(52) U.S. Cl.
CPC ..... *E21B 33/13* (2013.01); *E21B 33/05* (2013.01)

(58) Field of Classification Search
None
See application file for complete search history.

(56) References Cited

U.S. PATENT DOCUMENTS 2,933,136 A * 4/1960 Ayers ..... C09K 8/72 166/284
5,494,107 A * 2/1996 Bode ..... E21B 33/14 166/242.8
7,322,412 B2 * 1/2008 Badalamenti ..... E21B 21/10 166/177.4
8,851,172 B1 * 10/2014 Dudzinski ..... E21B 33/138 166/193
2012/0205120 A1 * 8/2012 Howell ..... E21B 34/108 166/373
2012/0222862 A1 * 9/2012 Ferg ..... E21B 21/10 166/294

* cited by examiner

*Primary Examiner* — Shane Bomar
(74) *Attorney, Agent, or Firm* — Karen B. Tripp

(57) ABSTRACT

A process for plugging a wellbore, e.g., an oil or gas well, which comprises installing a backpressure ball device into the wellbore to increase the back pressure for better control when introducing cement or other liquid plugging medium to plug the wellbore. The device has a spherical shape with through bores and/or external channels in a geometric pattern. The external diameter of the sphere provides a shoulder of given diameter which, when the device is installed in a wellbore, comes to rest against a smaller diameter shoulder within the wellbore. The device may free fall for all or part of the way down the wellbore but is typically pumped down at least for the last part of its delivery to confirm by an increase in pump pressure that it has landed. Cement and other liquid may then be pumped through the backpressure ball device to the distal region of the well. The backpressure ball device may also be applicable for use in the operation of an oilfield by providing backpressure to actuate drive rods.

13 Claims, 10 Drawing Sheets

BACKPRESSURE BALL

RELATED APPLICATION

This application claims priority from U.S. Provisional Patent Application No. 61/946,880, filed Mar. 2, 2014 by Thomas Eugene Ferg, entitled "Backpressure Ball,", and from U.S. Provisional Patent Application No. 61/976,349, filed Apr. 7, 2014, by Thomas Eugene Ferg, entitled "Backpressure Ball with External Flow Channels".

FIELD OF THE INVENTION

This invention relates to a method and apparatus for partial restriction of flow into subterranean wellbores and for creating backpressure for the placement of wellbore abandonment materials when such wells are being plugged and abandoned or worked over. This invention can also be useful in the placing of plugging material in plug and abandonment operations within a wellbore (such as e.g., an oil or gas well), or for preparing a wellbore to be plugged, e.g., when the wellbore has reached the end of its productive life. The invention also relates to a plugged wellbore.

BACKGROUND OF THE INVENTION

When an oil or gas well is no longer economical, or if there is some problem with the well which means that production is no longer possible or that well integrity has been compromised in some way, or for other reasons, the well may be abandoned. It is common practice to plug the well before abandoning it, e.g., to prevent seepage of hydrocarbon product or water from the well. This can also apply to water injectors, i.e. bores which have been drilled in order to pump water into a reservoir to increase bottom hole pressure.

Commonly, plugging may be achieved by injecting a settable substance or medium, e.g., cement, into the well. A well will normally have production perforations, that is to say apertures in a well liner or casing through which hydrocarbon product enters from the rock formation and travels to the surface. During plug and abandonment operations it is common to seal ("squeeze") production perforations with cement or another settable medium which may then form a permanent barrier to flow across the perforations and out of the well.

The well to be plugged and abandoned may in some cases have production screens or be gravel packed.

The plugging process often involves pumping a surfactant liquid, known as a "spacer", into the well. The purpose of the spacer is to remove oil residues from the internal surface of the well casing and/or liner and rock matrix making them "water wet" (allowing better adhesion by cement). Commonly, immediately following the spacer, cement is pumped down the well to occupy the part of the well casing and/or liner where perforations are to be squeezed. The cement may also be used to seal off production screens or gravel packed completions. When sufficient cement has been pumped down, more spacer liquid and possibly other liquids may be pumped down the well in order to place the cement at its final designed location.

It is desirable to be able to monitor with a reasonable degree of accuracy where the different constituents of the liquid column are located at any given time and the associated surface pumping (treating) pressure. It is also desirable to be able to control the progress of the liquid column, and other materials being displaced, by varying pressure on the column applied at the surface. For these things to be achieved, it is helpful to have a continuous column of liquid being pumped into the well.

It is therefore desirable to have sufficient reservoir pressure entering the well ("bottom hole pressure") to support a standing column of relatively high specific gravity material, e.g., spacer liquid, cement and displacement fluid, reaching to the top of the well. The spacer and cement and other liquids may then be pumped down against this pressure and thereby an accurate determination of each constituent's location can be determined at any given point within the process.

In many cases, the bottom hole pressure is insufficient to support a standing column of fluid reaching the wellhead at surface. In this event, positive pressure against the fluid column at the surface cannot be maintained as liquids are introduced into the top of the well. This results in liquid free falling down the wellbore and out through the reservoir completion, i.e. the perforated section of casing/liner or screen.

In this situation, it is often not possible to monitor when the cement has reached the desired wellbore location with respect to placement for sealing the wellbore. Without an accurate understanding of where the cement is, it is possible to over-displace the cement by continuing to introduce fluid at the surface which freefalls and over displaces the cement, with the result that the proximal perforations or screens not being effectively squeezed. Alternatively, it is possible to under-displace the cement thereby leaving distal perforations or screens unplugged and at the same time creating a barrier in the more proximal part of the liner hindering further optimized plugging operations within the wellbore without revision to procedures.

In the past, attempts have been made to address these issues by the addition of solid plugging material to the liquid plugging fluid or by displacement of the liquid plugging fluid with a low specific gravity fluid.

The addition of solid plugging material partially closes off pathways at the perforations, screens or gravel pack creating backpressure or the need for additional pumping pressure at the well surface in order to displace the plugging to the desired location. Thus a positive pressure on the fluid column is maintained at the well surface. Partly closing perforations with solid material can be undesirable since the perforations can end up not adequately sealed. Conversely, because there is little control over the degree of plugging and at which point the plugging will occur, an undesirable outcome can result if all perforations or screens are plugged off with solid medium prior to achieving the desired designed displacement.

Similarly, displacement of the plugging fluid with a significantly lower specific gravity fluid may also allow positive pressure to be maintained at the well surface. However, there are a limited number of available low specific gravity fluids and the constituents incorporated in them that meet design requirements.

BRIEF SUMMARY OF THE DISCLOSURE

The invention provides a process for plugging a wellbore wherein the process comprises the steps of (a) introducing and installing a backpressure ball device into the wellbore, the device having multiple through bores in a geometric pattern. The geometric through bore pattern creates roughly the same total flow area (TFA), when the device has been landed, and creates backpressure no matter in which orientation that the ball seats. The invention is particularly applicable when the bottom hole pressure of the wellbore is insufficient to support a standing column of liquid of specific gravity reaching to the surface.

The invention also provides a process for plugging a wellbore wherein the process comprises the steps of (a) introducing and installing a backpressure-ball-with-external-channels device into the wellbore, the device having surface channels in a geometric pattern. The geometric surface channel pattern creates roughly the same total flow area (TFA), when the device has been landed, and creates backpressure no matter in which orientation that the ball seats. The geometric surface channel pattern creates roughly the same backpressure no matter in which orientation that the ball seats. The invention is particularly applicable when the bottom hole pressure of the wellbore is insufficient to support a standing column of liquid of specific gravity reaching to the surface.

The invention also provides a process for plugging a wellbore wherein the process comprises the steps of (a) introducing and installing a backpressure ball device into the wellbore, the device having multiple through bores in a geometric pattern in combination with external channels in a geometric pattern. The through bores and geometric surface channel pattern create roughly the same total flow area (TFA), when the device has been landed, and backpressure no matter in which orientation that the ball seats. The invention is particularly applicable when the bottom hole pressure of the wellbore is insufficient to support a standing column of liquid of specific gravity reaching to the surface.

The term "backpressure ball device" as used herein refers to any spherical device introduced and landed to create backpressure which incorporates through bores, surface channels or facets in any combination or geometric orientation.

The backpressure ball device may be installed by allowing it to free fall down the well or roll into position or by pumping it down the well, or a combination of these three. If the wellbore includes a nipple, the backpressure ball device may bottom out at the nipple.

If a landing nipple is not present within the wellbore a packer may be introduced and set at a desired depth. The internal diameters of the packer or its top shoulder may be used as a landing shoulder for a backpressure ball device that is slightly larger than the through bore of the packer.

When pumping fluid downhole a sustained surface pressure increase at a given pump rate will indicate that the backpressure ball device has reached the nipple and stops or reaches a landing shoulder and stops.

If a wellhead or "christmas tree" is located at the top of the wellbore, the step of installing the backpressure ball device may include inserting the device between the swab valve and the master valve (top or bottom master valve) and then closing the necessary valves above the device and opening the necessary valves below the device to gain access to the wellbore.

To plug the wellbore, settable medium (such as cement) may be injected through the backpressure ball device into the distal part of the wellbore, that is to say the part beyond the backpressure ball device. Surfactant may be injected into the wellbore before the settable liquid, and another liquid may be injected after. The pressure at the surface would normally be monitored in which case it may be possible to determine from the monitored pressure when the settable medium reaches the backpressure ball device because of a variance in the rheology between fluids.

The backpressure ball device comprises a spherical body capable of being passed down a wellbore. The body will be of larger diameter than the shoulder upon which it will be landed.

A method of preparing a wellbore for plugging may comprise inserting into the wellbore a backpressure ball device as described above. The method may include pumping into the wellbore and thus applying pressure to the backpressure ball device, thereby pumping the device through the wellbore, and subsequently when the device has landed, increasing the pressure to a level at which a continuous column of fluid may be maintained from the backpressure ball device to the pump.

The invention also relates to a plugged wellbore having located in it a backpressure ball device as described above.

The term "wellbore" as used herein shall be taken to mean an oil or gas well or a water injector.

BRIEF DESCRIPTION OF THE DRAWINGS

A more complete understanding of the present invention and benefits thereof may be acquired by referring to the following description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
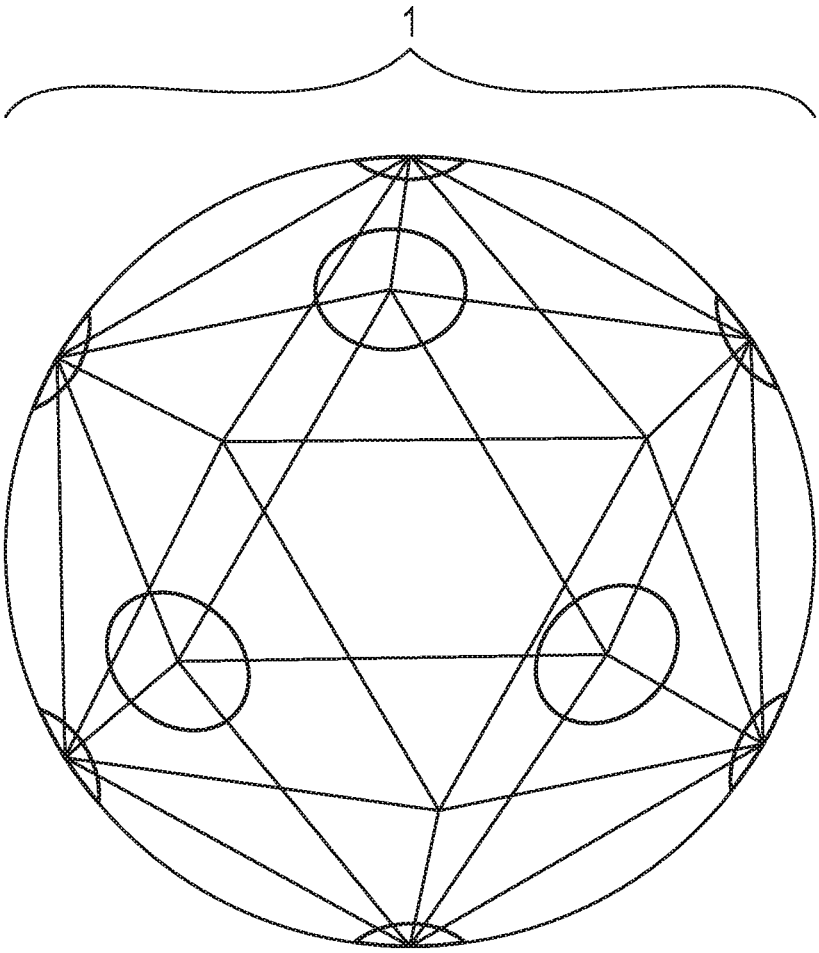
FIG. 1 is a side view of an icosahedron example backpressure ball device having multiple through bores in accordance with one embodiment of the invention (1)

FIG. 1 shows one embodiment of a backpressure ball device (1) of the present invention—comprising a spherical body comprised of metal or plastic with through bores placed in geometric patterns. The through bores may be varied in diameter and orientation. This example is for an icosahedron encased within the sphere. Through bores are made from the contact point where the geometric figure meets the sphere surface. Through bores are from that contact point through to the center of the sphere. In one embodiment, the through bores may also continue through to the other side of the sphere. A tetrahedron, dodecahedron or any other symmetrical geometric shape may alternatively be used.

Figure 2:
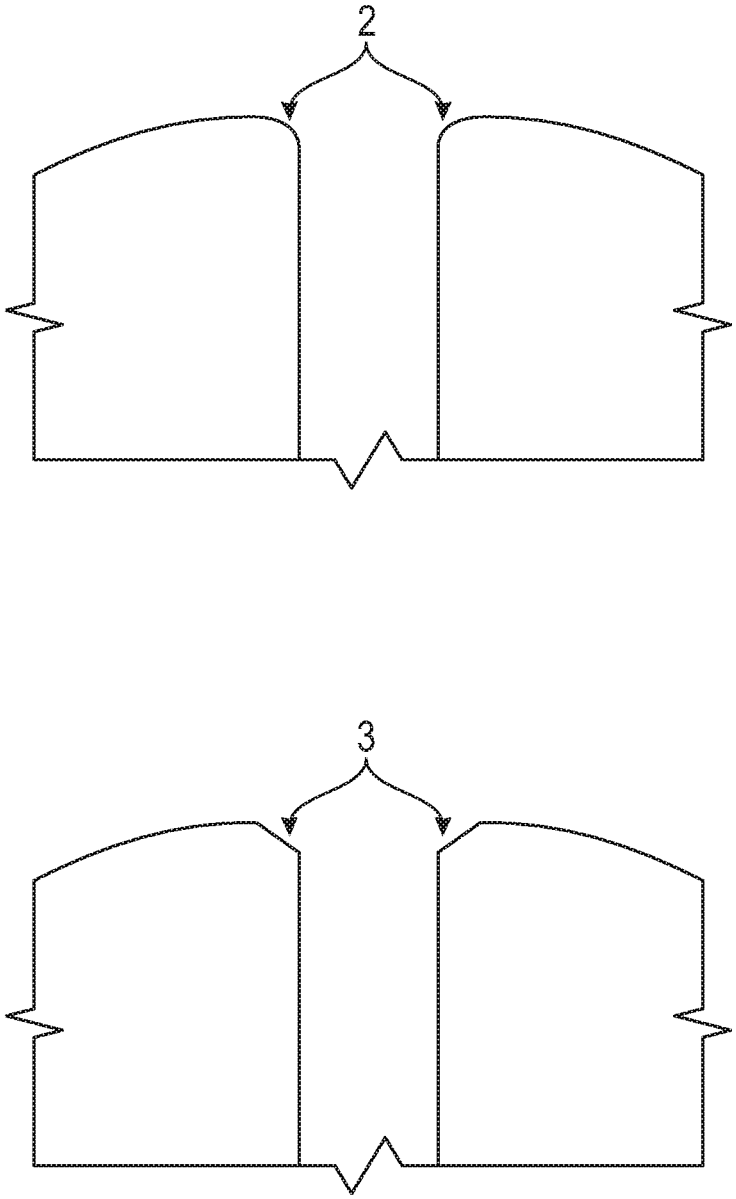
FIG. 2 shows a cross sectional view of the boreholes through the backpressure ball device of FIG. 1 with eased entry edges; (2)—quarter round edges and (3) chamfered edges.

FIG. 2 shows eased or rounded surfaces (2) and chamfered surfaces (3) of the through bores where the bores meet the surface of the spherical body (1) of FIG. 1. The easing of through bores is to help reduce fluid turbulence when entering and exiting the through bore (2) and (3).

Figure 3:
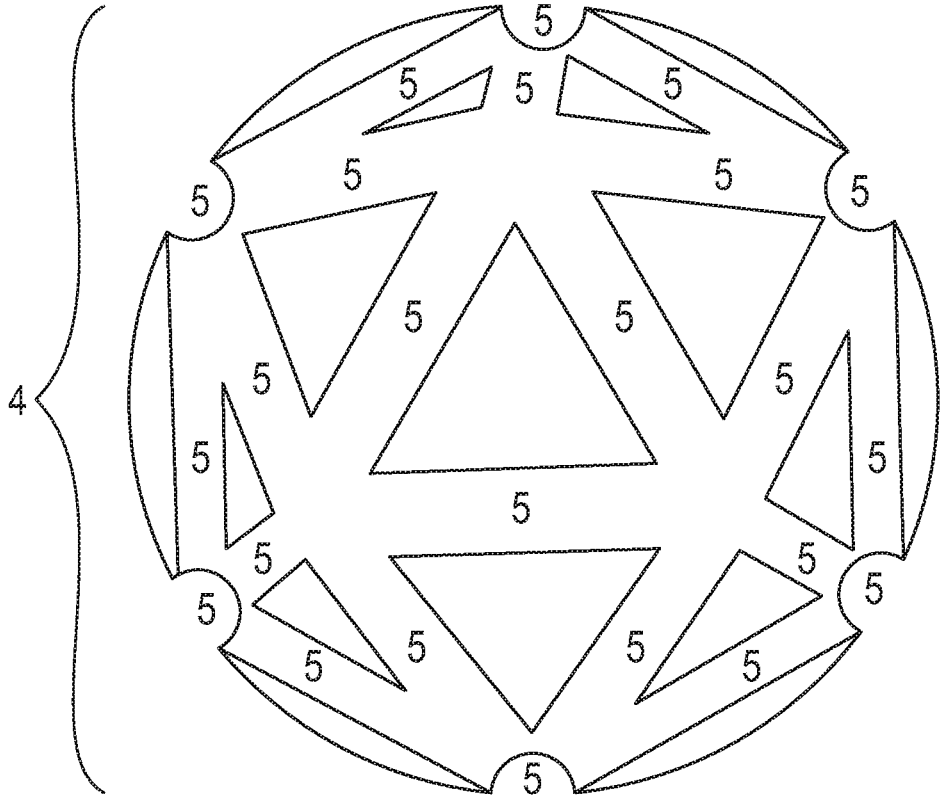
FIG. 3 shows a backpressure ball device (4) with surface channels (5) on the vertices of an icosahedron projected onto the sphere in accordance with another embodiment of the invention.

FIG. 3 shows another embodiment of the backpressure ball device (4) of the invention, a backpressure-ball-with-external-channels device—comprising a spherical body comprised of metal, composite or plastic with external channels originating where the vertices of the symmetrical geometric form contacts the sphere. The surface channels (5) are cut from the vertices along the geometric form edge where the encapsulated figure intersects the sphere. The depth and shape of the channels (5) are uniform along a constant radius with a rotational point located at the center of the sphere. The symmetrical geometric form used for this example is an icosahedron encapsulated within a sphere, however any symmetrical geometric form could alternatively be used.

Figure 4:
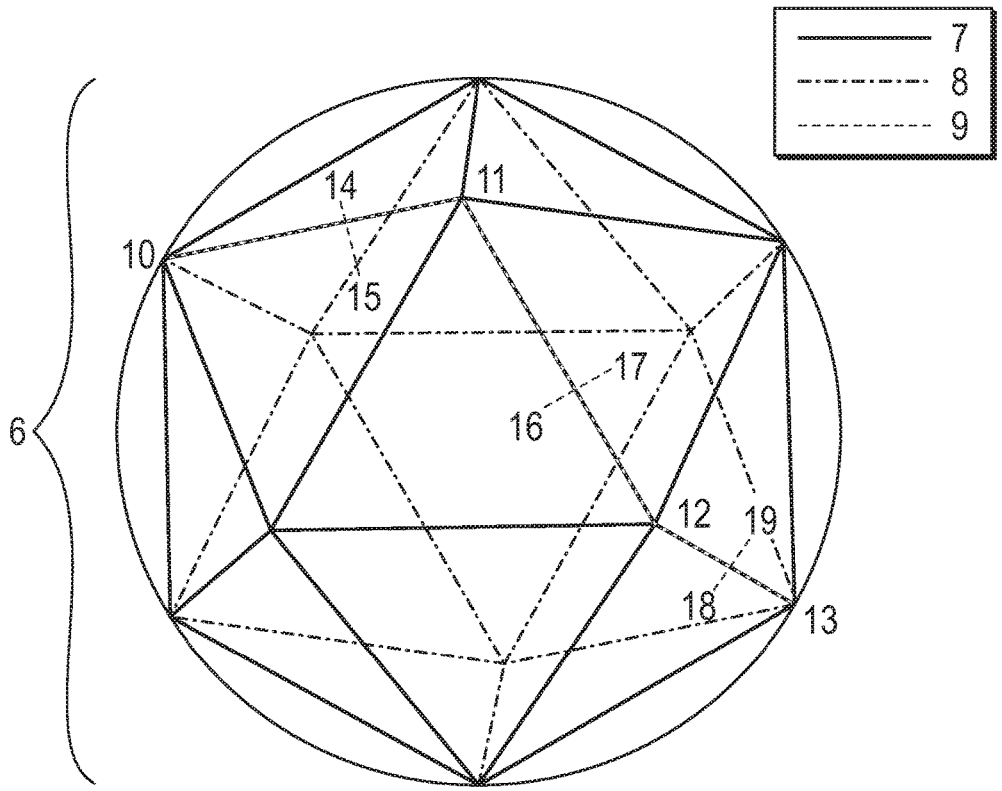
FIG. 4 shows the backpressure ball device (6) with the icosahedron projected within the sphere with solid lines (7) being closest in view and the dot-dash lines (8) being farthest away; the small dotted line (10, 11, 12 &13) denotes the projected line of a cross-section for FIG. 5.

FIG. 4 shows the backpressure ball device (6) with the icosahedron projected within the sphere. In FIG. 4, solid lines (7) indicate vertices that project on the near surfaces of the sphere which encloses the geometric form, dot dash lines (8) indicate the vertices which are projected on the far surface of the sphere and the dotted lines (9) indicate where the cross-sections illustrated in FIG. 5 are taken from.

Figure 5:
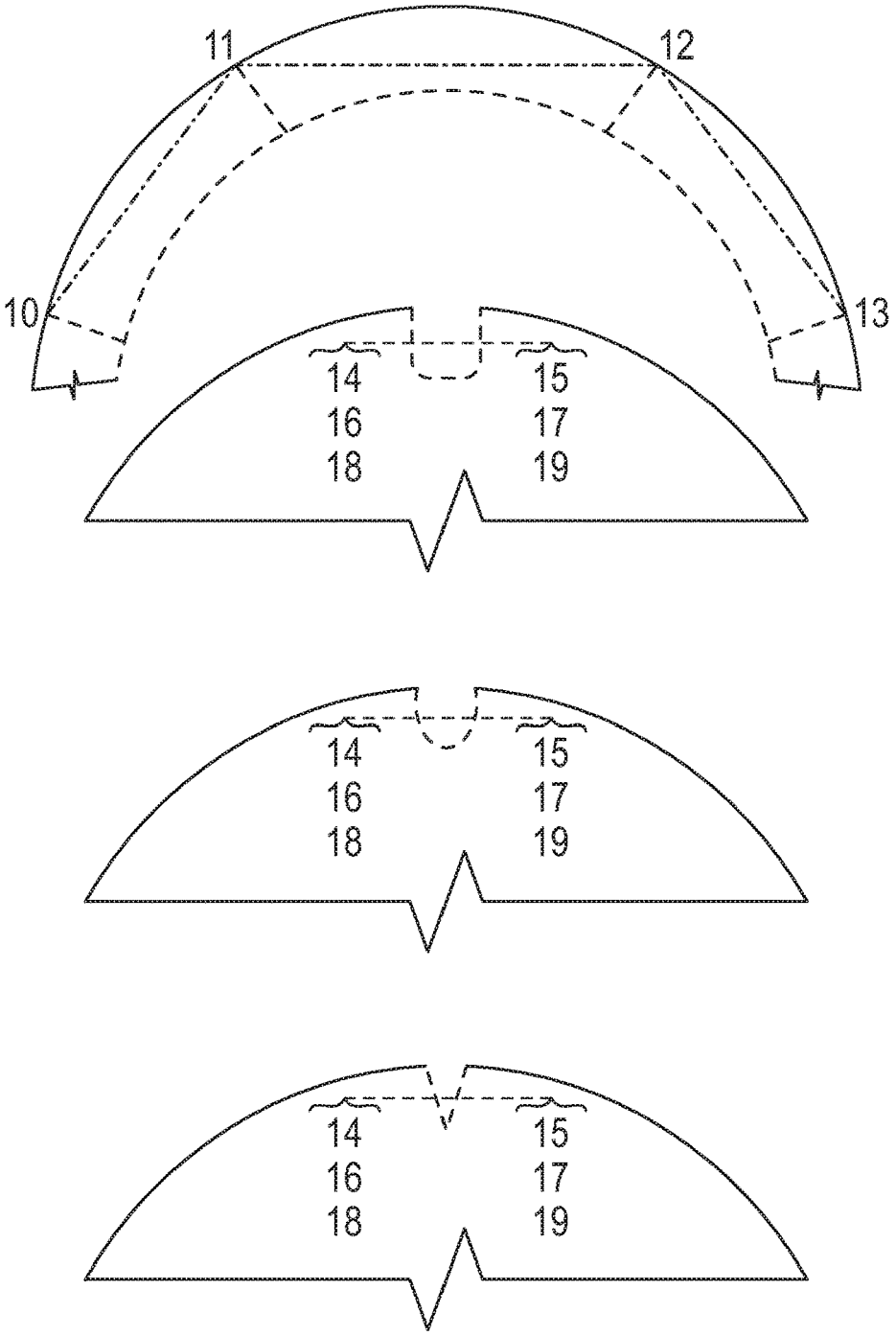
FIG. 5 has the same numbering as FIG. 4 because these two Figures provide different projections of the same elements. Points designated (10), (11), (12) and (13) show the pathway of a cross-section; dotted lines designated as (14)-(15), (16)-(17) and (18)-(19) are used in the cross-sectional view of FIG. 5; various potential surface channels are shown, however those which are shown are by no means intended to show all potential channel variations.

FIG. 5 references the points in FIG. 4. The cross section from across points (10), (11), (12) & (13) show the constant radius depth of the external channels. Cross sections (14-15), (16-17) & (18-19) show a few examples of the many potential channel cross sections.

Figure 6:
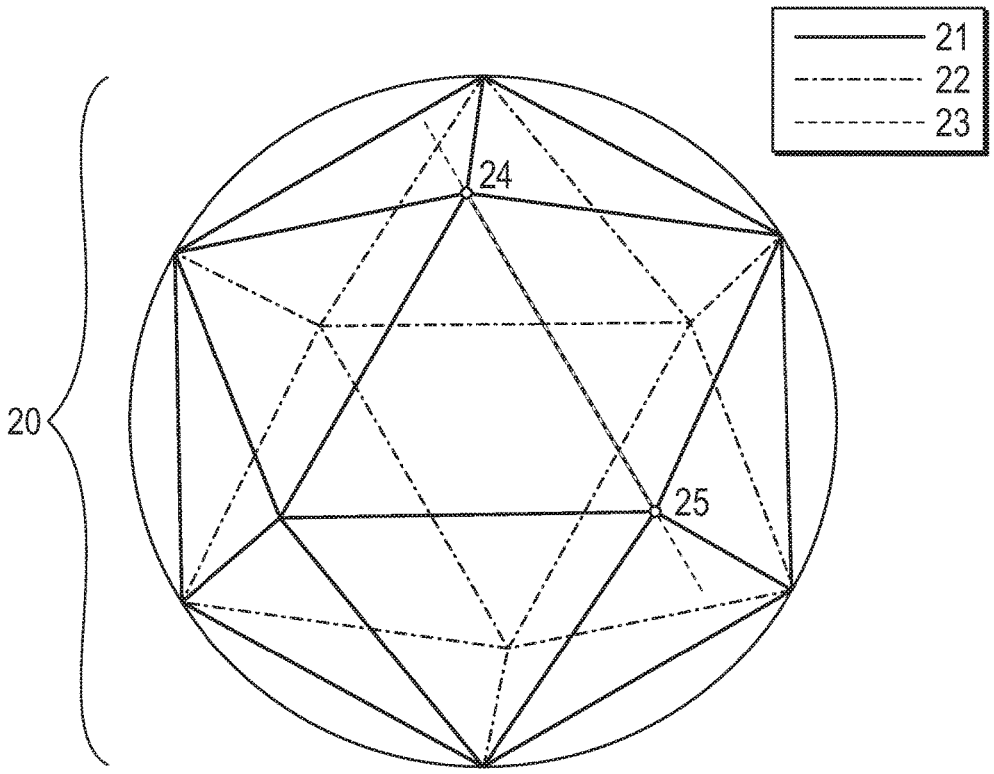
FIG. 6 shows another embodiment of a backpressure ball device (20) of the invention having both external channels and through bores, with solid lines (21) being closest in view and the dot dashed lines (22) being farthest away; the small dotted line (23 denotes the projected line (24) to (25) which is cross-sectioned in FIG. 7.

FIG. 6 shows another embodiment of a backpressure ball device (20) of the invention having both external channels and through bores. This Figure shows from where the cross sections which are illustrated in FIG. 7 between points (24) and (25) originate.

Figure 7:
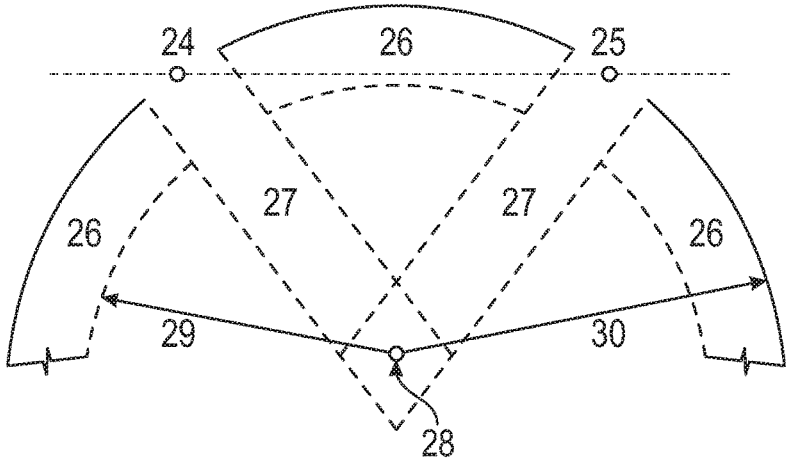
FIG. 7 shows a schematic detail of the embodiment of a backpressure ball device of the invention shown in FIG. 6 with both external channels (26) and through bores (27) with the center of the sphere at point (28). The external radius of the sphere is denoted by (30) and the internal radius of the external channel is denoted by (29). The boreholes from the surface of the sphere to the center are denoted by (27)

FIG. 7 shows the center of the sphere (28), the basal radius of the external channels (29), the radius of the sphere (30) and cylindrical bores from the sphere surface (24) and (25) to the center of the sphere (28). The through bores (27) may be varied in diameter and orientation. This example embodiment of the backpressure ball device of the invention is for an icosahedron encased within a sphere. Through bores are made from the contact point where the geometric figure meets the sphere surface. Through bores are from the contact point through to the center of the sphere. The through bores may also continue through to the other side of the sphere. A tetrahedron or any other symmetrical geometric shape may alternatively be used. This FIG. 7 presents the possibility of combining surface channels and bores into a single backpressure ball device.

Figure 8:
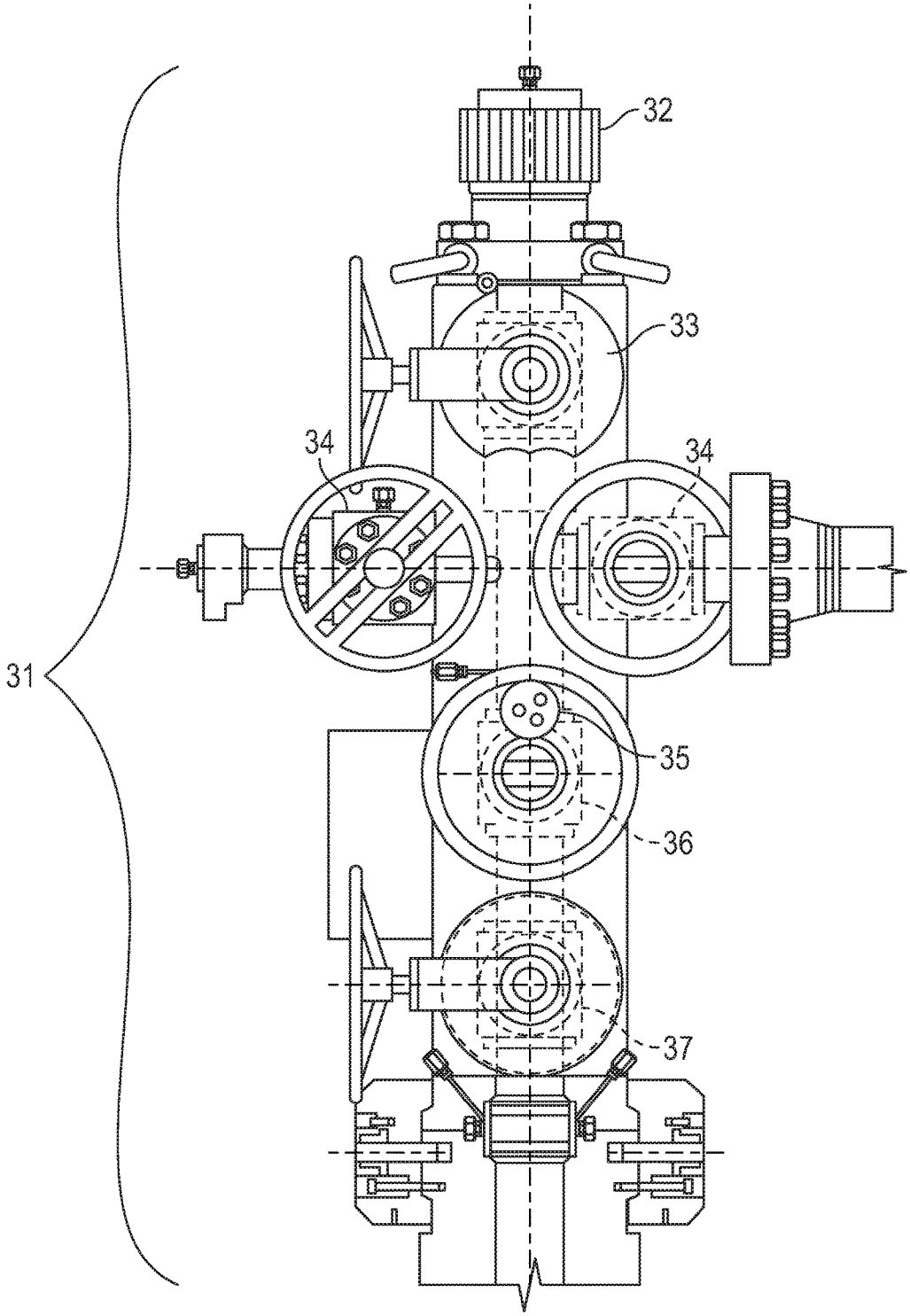
FIG. 8 is a well christmas tree (31) with a backpressure ball device (35) sitting on the closed top master valve (36) loaded and ready for launching down the wellbore. The tree cap is designated by (32), the swab valve is designated by (33), wing valves are labelled as (34) and the bottom master valve is labelled (37).

FIG. 8 shows the christmas tree valve arrangement at the top of a wellbore to be plugged. The external diameter of the backpressure ball device (35) is chosen so that it will pass through the christmas tree (31). The swab cap (32) is at the top of the tree. Progressing through the valves from top down are the swab valve (33), wing valves (34), top master valve (36) and bottom master valve (37). The external diameter of the backpressure ball device (35) is shown placed inside the tree on top of the top master valve (36). The overall outer diameter of the backpressure ball is chosen so that it will pass down the well to a landing point, shoulder or nipple just above the reservoir. The diameter of the backpressure ball device is sized so that the device can travel from the tree at surface down the wellbore and land on a shoulder within a nipple. While this FIG. 8 shows backpressure ball device (35) for illustration, other embodiments of the backpressure ball device of the invention could alternatively be used.

Figure 9:
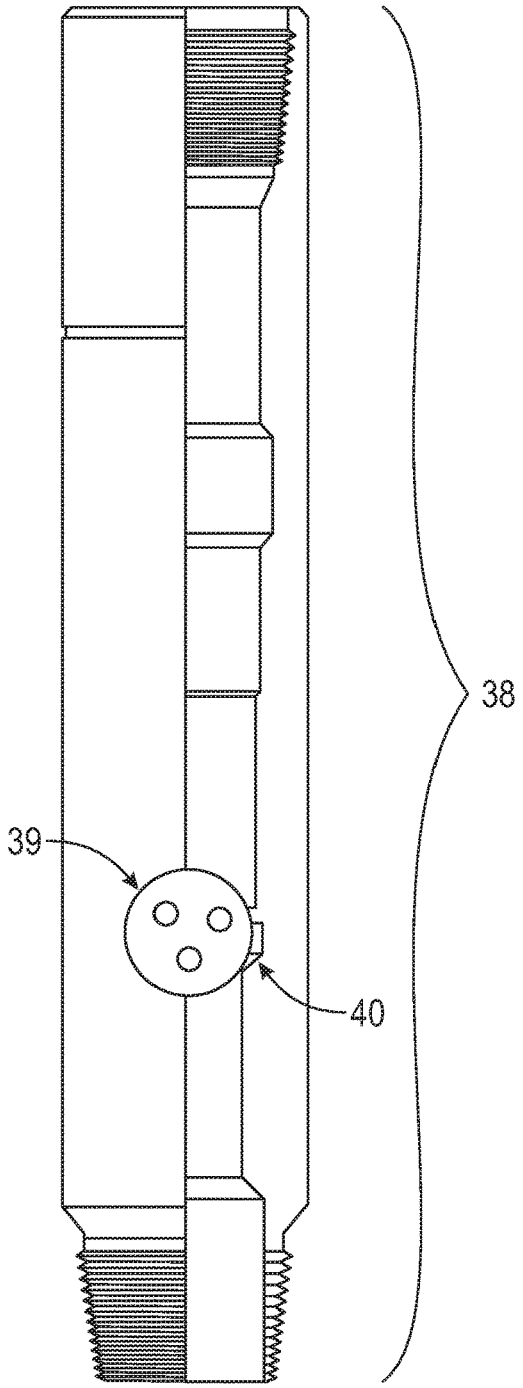
FIG. 9 is a side view, partly in section, of part of a wellbore showing the backpressure ball device (39) landed against a shoulder (40) in a downhole nipple (38) within a wellbore.

FIG. 9 shows a landing nipple (38) with a backpressure ball device (39) landed on the nipple shoulder at (40).

Figure 10:
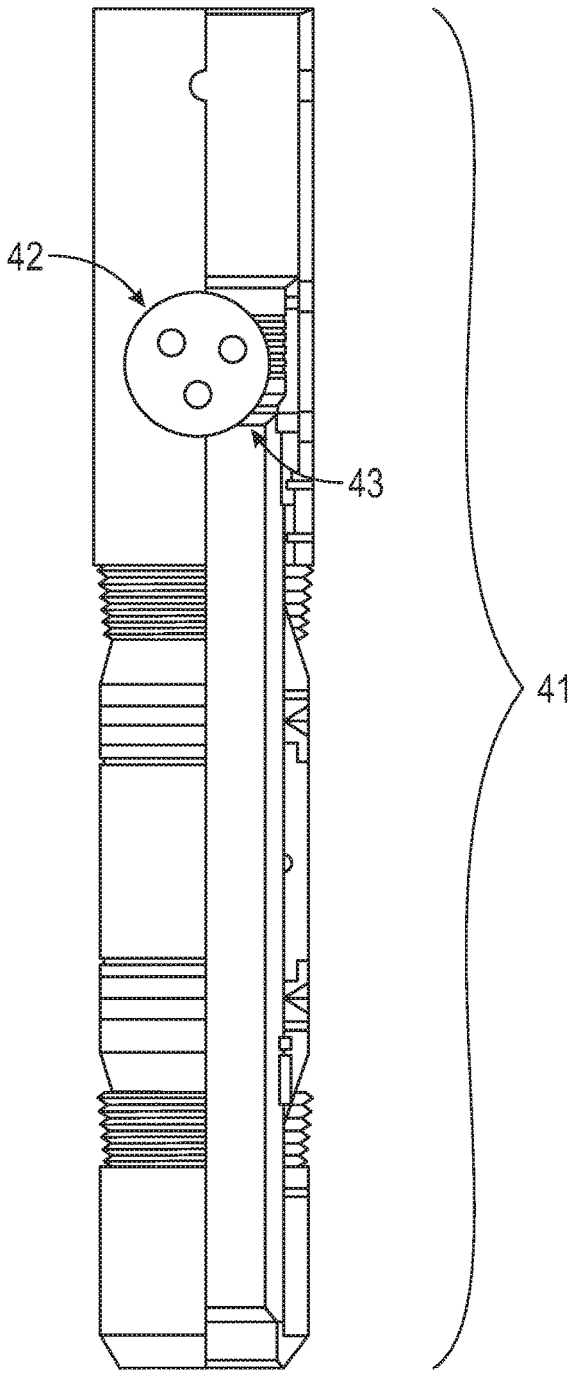
FIG. 10 is a side view, partly in section, of part of a wellbore showing the backpressure ball device (42) seated on a shoulder (43) inside of a set downhole packer (41).

FIG. 10 shows a packer (41) with an internal shoulder (43) where the backpressure ball device (42) is landed.

Figure 11:
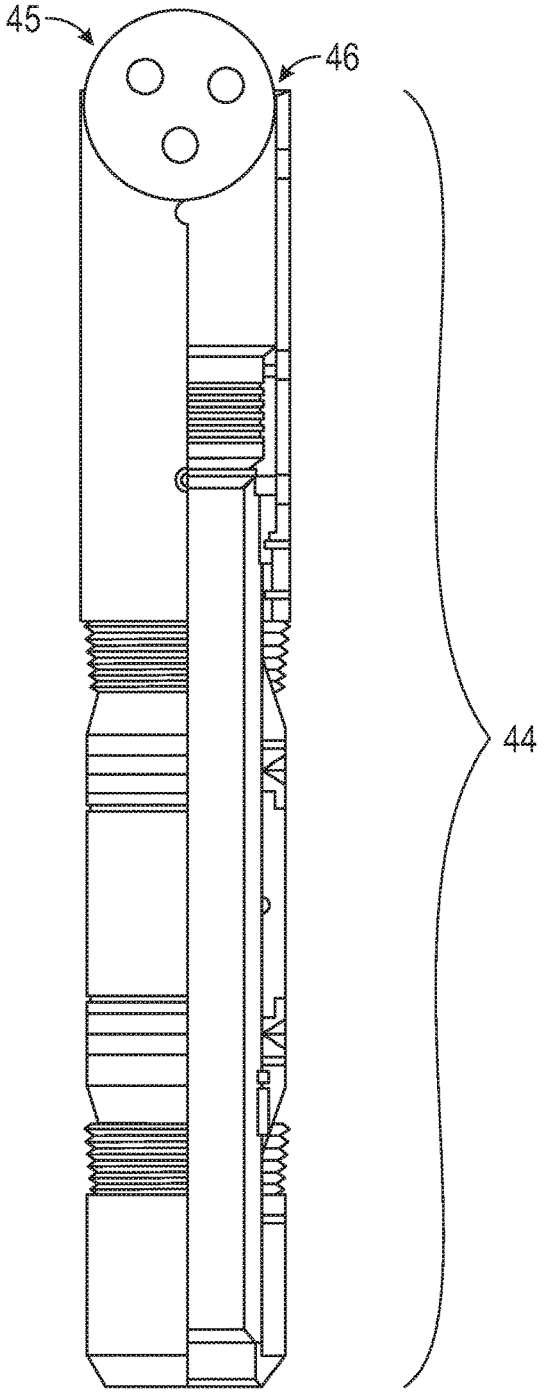
FIG. 11 is a side view, partly in section, of a downhole packer (44) showing the backpressure ball device (45) seated on the top shoulder (46) of the packer.

FIG. 11 is a side view, partly in section, of a packer (44) showing the backpressure ball device (45) seated on the top edge or shoulder (46) of the packer.

Before plugging a well, sea water is pumped down the well to determine whether it is possible to inject liquid into the perforations in the producing part of the well (not shown), that is, the part of the well to be squeezed (blocked with cement or other plugging fluid). A gage device, of similar or slightly larger diameter than the backpressure ball device of the invention is introduced to the wellbore. The gage device is lowered into the wellbore and traverses the tubular from the well surface to the surface where the backpressure ball device will be landed. This operation is used to determine whether any obstructions are present which may obstruct and prevent the correct positioning of the backpressure ball device.

This having been done, the bottom master valve (37) and swab valve (33) of FIG. 8 are closed and any trapped pressure is bled off between them through one of the wing valves (34). The top master valve (36) is then closed. The swab cap (32) is removed and the swab valve (33) is then opened and the backpressure ball device (35) is then inserted into the christmas tree (31) and is positioned on the top of the top master valve (36). The swab valve (33) is then closed along with the wing valves (34), then the upper master valve (36) is opened to allow the backpressure ball device to land on top of the bottom master valve (37). The top master valve (36) is then closed and the bottom master valve (37) is then opened to allow the backpressure ball device (35) to free fall down the wellbore. In a simple vertical well, the backpressure ball device reaches the desired landing shoulder (40) within the nipple (38) of FIG. 9. In a well with higher inclination the backpressure ball device will roll along the bottom surface of the tubular without pumping. However, the backpressure ball device may require pumping into position if the well has an inclined or horizontal portion at the landing point (shoulder). Sea water or fresh water is normally used for this purpose. Pumping continues until the back pressure increases, indicating that the backpressure ball device has come to rest at the profile (40) within the nipple (38). Step rate tests are then conducted to determine the amount of back pressure created by the backpressure ball device at increasing injection rates. This data is used to refine the predicted surface treating pressure profile expected during placement of the plugging fluid.

Spacer fluid, a specialized mixture of chemicals including surfactants, is then pumped down the well at a rate sufficient to maintain positive pressure and contact with the top of the fluid column. The backpressure ball device of FIG. 1 with geometrically patterned through bores, allows the fluid column to maintain the positive back pressure. Cement is then delivered in a continuous liquid column directly following the spacer fluid. A further liquid or liquids, e.g., further spacer fluid or other liquids, follow the cement in a continuous liquid column. Pressure continues to be applied to the cement via this liquid column, and back pressure continues to be monitored.

A wiper plug may be launched down the wellbore at the tail end of the cement slurry to land out on the backpressure ball sealing the wellbore preventing further downward movement of cement or plugging medium and effectively locking the backpressure ball in place.

As a variation a wiper plug which lands out within a nipple, packer bore or packer top may be launched at the tail end of the cement slurry to prevent further forward movement of the plugging medium.

As the spacer/cement interface passes the backpressure ball device 1, a pressure change may be recorded at the well surface due the change in fluid density and rheology and the volume of the wellbore tubulars down to the backpressure ball device can be confirmed. When the tail of the cement column passes the backpressure ball device 1, a further change in surface pressure may be noted due to the changes in fluid viscosity and density. The aim is to squeeze all the completion and have a cement column or plug remain within the tubular but not to over- or under-displace the cement column.

The backpressure ball device of the invention can be used in other tubular applications as will be readily understood by one of ordinary skill in the art, and particularly coiled tubing applications. For example, the backpressure ball device can be used to provide positive activation pressure for drilling, workover, completion and plug and abandonment tools with tubular drive rods.

The discussion of any reference herein is not an admission that the reference is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventor that variations and equivalents of the invention are within the scope of the claims while the description, abstract and drawings are not to be used to limit the scope of the invention. The invention is specifically intended to be as broad as the claims below and their equivalents. No limitations are intended to the details of construction or design herein shown, other than as described in the claims below. While products and methods are described in terms of "comprising," "containing," "having," or "including" various components or steps, the products and methods can also "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee."

What is claimed is:

1. A process for plugging a wellbore through sealing off a wellbore cross-section with a settable medium, wherein the process comprises the steps of:

a) installing a spherical backpressure ball device in the wellbore, wherein the backpressure ball device has through bores with a predetermined diameter in a geometric pattern, or external channels with predetermined flow cross-sections in a geometric pattern, or both through bores and external channels in a geometric pattern, wherein the wellbore includes a nipple or shoulder downhole, such that the backpressure ball device bottoms out or lands on the shoulder or nipple because the diameter of the backpressure ball device is larger than the diameter of the shoulder or nipple, and wherein the backpressure ball device creates backpressure no matter the orientation of the backpressure ball device on the nipple or shoulder, which backpressure can be used for monitoring the position of the settable medium and for effecting and/or maintaining a continuous fluid or liquid column of settable medium down the wellbore; and b) injecting a settable medium into the wellbore and pumping it downhole to effectively seal off the wellbore cross-section.

2. The process according to claim 1 wherein the wellbore has bottom hole pressure insufficient to support a standing column of liquid of a given specific gravity reaching to the surface of the wellbore.

3. The process according to claim 1 wherein the step of installing the backpressure ball device comprises allowing the backpressure ball device to free fall down the wellbore.

4. The process according to claim 1 wherein the step of installing the backpressure ball device comprises pumping the backpressure ball device down the wellbore.

5. The process according to claim 1 wherein located at the top of the wellbore is a christmas tree with a swab valve, a top master valve and a bottom master valve and wherein the step of installing the backpressure ball device comprises inserting the backpressure ball device between the swab valve and the top master valve, closing the swab valve and then opening and closing the top master valve and then opening and closing the bottom master valve to allow the backpressure ball device to enter the wellbore.

6. The process according to claim 1 wherein a proximal part of the wellbore is defined as between the backpressure ball device on the shoulder or nipple and the surface of the wellbore and the distal part of the wellbore is defined as the part beyond the backpressure ball device and distal the surface of the wellbore.

7. The backpressure ball device of claim 1 having flow channels with a predetermined total flow area (TFA) and surface back pressure while fluid is introduced into the wellbore by pumping when the backpressure ball device is landed downhole.

8. The process according to claim 1 further comprising the step of injecting a fluid surfactant into the wellbore prior to injecting the settable medium.

9. The process according to claim 1 wherein the step of injecting a settable medium comprises flow through channels of the backpressure ball device into the part of the wellbore beyond the device and distal the surface of the wellbore.

10. The process according to claim 1 further including the launching of a wiper plug, following the introduction of the settable medium, to land out on the backpressure ball device or a shoulder within the portion of the wellbore between the surface of the wellbore and the backpressure ball device.

11. The process according to claim 8 further comprising the step of injecting a liquid after injecting the settable medium.

12. The process of claim 11 comprising monitoring pressure at the surface of the wellbore while pumping and displacing the fluid surfactant, settable medium and the liquid.

13. The process of claim 12 further comprising determining from changes in said monitored pressure when the settable medium reaches the backpressure ball device.

* * * * *